United States Patent [19]

Namiki

[11] Patent Number: 4,910,556

[45] Date of Patent: Mar. 20, 1990

[54] DEVELOPING ROLLER FOR USE IN AN IMAGE RECORDER

[75] Inventor: Yoshikazu Namiki, Yokohama, Japan

[73] Assignee: Ricoh Company, Ltd., Tokyo, Japan

[21] Appl. No.: 314,099

[22] Filed: Feb. 22, 1989

[30] Foreign Application Priority Data

Feb. 24, 1988 [JP] Japan ..... 63-39476

[51] Int. Cl.[4] ..... G03G 15/08

[52] U.S. Cl. ..... 355/245; 355/261; 118/651

[58] Field of Search ..... 355/245, 259, 261, 265, 355/282, 295; 118/651, 661

[56] References Cited

U.S. PATENT DOCUMENTS

| | | | |
|---|---|---|---|
| 4,282,303 | 8/1981 | Bergen | 355/259 X |
| 4,309,803 | 1/1982 | Blaszak | 118/651 X |
| 4,395,110 | 7/1985 | Hosono et al. | 355/259 |
| 4,521,098 | 6/1985 | Hosoya et al. | 355/245 |
| 4,539,908 | 9/1985 | Spengler | 118/651 X |
| 4,710,015 | 12/1987 | Takeda et al. | 355/259 |
| 4,827,305 | 5/1989 | Enoguchi et al. | 355/259 |
| 4,827,868 | 5/1989 | Tarumi et al. | 355/259 X |

*Primary Examiner*—A. C. Prescott

*Attorney, Agent, or Firm*—Oblon, Spivak, McClelland, Maier & Neustadt

[57] ABSTRACT

A developing roller in a one-component developer type image recorder and held in contact with an image carrier for developing a latent image in the form of an electrostatic charge provided on the image carrier, has a metal core, an elastic layer provided on the core and constituted by rubber and a softener, and a toner retaining layer provided on the elastic layer for retaining toner thereon. The toner retaining layer covers all of the surfaces of the elastic layer, i.e. the peripheral surface and opposite ends. The toner retaining layer is implemented by a resin or rubber which is oil-resistant and does not show affinity to the softener.

20 Claims, 1 Drawing Sheet

DEVELOPING ROLLER FOR USE IN AN IMAGE RECORDER

BACKGROUND OF THE INVENTION

The present invention relates to a developing roller and, more particularly, to a developing roller constituting a developing device of an electrophotographic copier, facsimile apparatus, printer or similar image recorder and held in contact with an image carrier of the image recorder for developing a latent image in the form of an electrostatic charge deposited on the image carrier by use of a dry one-component toner.

Dry process development adopted in the art of electrophotography and electrostatic recording which include an electrophotographic copier, facsimile apparatus and laser printer is implemented by either a two-component developer on a one-component developer. While a two-component developer is made up of toner and carrier, a one-component developer is constituted by toner only, as well known in the art. Image development using a two-component developer stably produces images of high quality, but cannot reproduce such images over a long period of time due to problems such as deterioration of the carrier and varying mixture ratio of the toner and carrier, etc. Another problem with the two-component developer is that a recording apparatus using such a two component carrier cannot be maintained or provided in a compact configuration with ease. In the light of this, image development using a one-component developer, which is free from such problems, is attracting increasing attention. The one-component developer, i.e., toner, may either be a magnetic toner or a non-magnetic toner.

In a developing system using a one-component toner as the developer, toner is supplied to a developing roller to develop a latent image in the form of an electrostatic charge which is formed on a photoconductive drum or similar image carrier. Among the many prerequisites for a developing roller of the type using non-magnetic toner, one is that it be provided with adequate elasticity and, preferably, with a predetermined conductivity. Typical of prior art developing rollers is a roller made up of a metal core, an elastic layer provided on the metal core, and a toner retaining layer provided on the elastic layer. However, the elastic layer has an electric resistivity of $10^{10}\ \Omega$ cm to $10^{16}\ \Omega$ cm, which is too high to cope with varying temperature and humidity. While conductive powder which serves as a conducting agent may be added to the elastic layer to lower its resistivity as heretofore practiced, such an approach brings about another problem in that elasticity is lost due to the substantial content of the conductive powder and, therefore, the developing roller fails to sufficiently make contact with the photoconductive drum during development. These related problems are usually dealt with by adding not only the conducting agent but also a substantial amount of softener to the elastic layer to assure effective contact of the developing roller and the drum. However, when this kind of prior art developing roller is used, various undesirable phenomena occur, such as the oooze-out of the softener through the surface of the toner retaining layer and the opposite ends of the elastic layer. The softener so oozing out causes the toner to harden.

SUMMARY OF THE INVENTION

It is therefore an object of the present invention to provide a developing roller for use in an image recorder which promotes desirable development despite the use of a dry one-component toner.

It is another object of the present invention to provide a developing roller feasible for an image recorder which is continuously operable over a long period of time.

It is another object of the present invention to provide a developing roller as set forth in the above objects for a one component type electrophotographic image recorder.

It is another object of the present invention to provide a generally improved developing roller for use in an image recorder.

In accordance with the present invention, a developing roller for an electrophotographic image recorder comprises an elongate conductive core, an elastic layer formed on the core and comprised by a rubber member and a softener, and a developer retaining layer formed on the elastic layer for retaining a one-component developer and comprised by a cover member which covers all surfaces of the eleastic layer. The cover member of the developer retaining layer is oil-resistant and does not show affinity to the softener which is contained in the elastic layer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
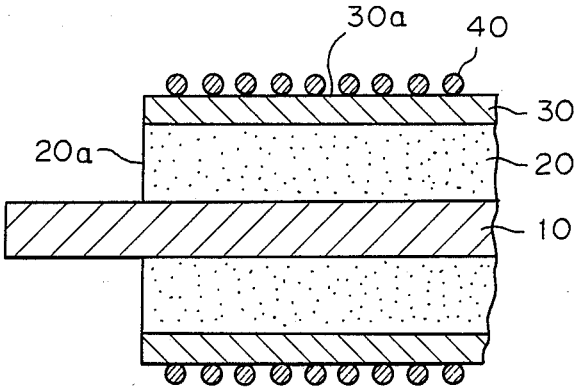
Fig. 1 PRIOR ART
FIG. 1 is a schematic view of a prior art developing roller.

To better understand the present invention, a brief reference will be made to a typical prior art developing roller, shown in FIG. 1. As shown, the developing roller is made up of a metal core or rotatable shaft 10, an elastic layer 20 provided on the metal core 10, and a toner retaining layer 30 provided on the elastic layer 20 for retaining toner particles 40.

The elastic layer 20 is implemented by NBR (nitrilbutadiene rubber), hydricone rubber, EPDM (ethylene-propylene-diene methylene polymer), silicone rubber, fluorine-containing rubber, EPR (ethylene-propylene rubber), CR (chloroprene rubber) or the like. The toner retaining layer 30 is made of carbon-containing urethane rubber or a similar material whose electrical resistivity is $10^{10}\ \Omega$ cm or so. A drawback with the elastic layer 20 is that its resistivity is as high as $10^{10}\ \Omega$ cm to $10^{16}\ \Omega$ cm and therefore it cannot cope with varying temperature and humidity. To eliminate this drawback, it is a common practice to add a substantial amount of powdery conducting agent to lower the resistivity of the layer 20 and to also add a substantial amount of softener for giving elasticity to the layer 20. Such additives allow the developing roller to make sufficient contact with a photoconductive element in the form of a drum, for example. However, when this kind of prior art developing roller is used, various undesirable phenomena occur such as the ooze-out of the softener through the surface 30a of the toner retaining layer 30 and the opposite ends 20a of the elastic layer 20. The softening agent so oozing out causes the toner to harden, as discussed earlier.

Figure 2:
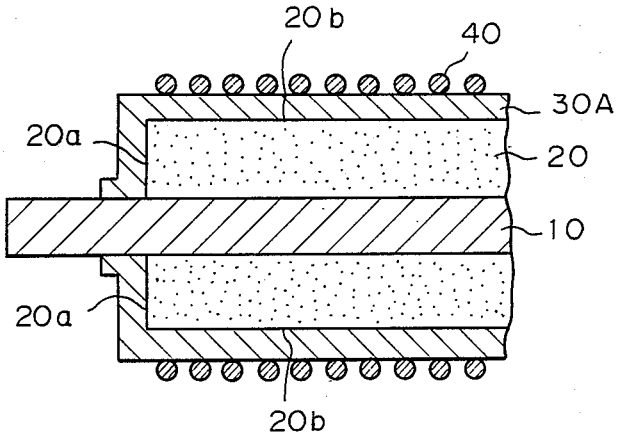
FIG. 2 is a view schematically showing a developing roller embodying the present invention.

Referring to FIG. 2, a developing roller embodying the present invention is shown. In FIG. 2, the same or similar structural elements as those shown in FIG. 1 are designated by like reference numerals. In the figure, a toner retaining layer 30A of the roller serves the function of a charge retainer and sheet layer which is so configured as to cover all of the surfaces of an elastic layer 20 including opposite ends 20a and peripheral surface 20b. As previously stated, the elastic layer 20 is chiefly implemented by NBR, hydricone rubber, EPR, EPDM, silicone rubber, IR (isoprene rubber), IIR (butyl rubber), BR (butadien rubber), SBR (butadiene-styene rubber) or similar material. Added to the elastic layer 20 is a softener such as fatty oil (stearic acid or castor oil), an extract made from crushed pine roots (pine tar), tolu oil, Factice, spindle oil, petroleum-based oil (paraffin or chlorinated paraffin), coal tar-based oil (coumarone-indene resin), ethylene glycol, synthetic resin-based oil (DOP or butylphenol acetylene condensation product), silicone oil, fluorine oil or the like. Should such a softener be simply added to the rubber which is the main component of the elastic layer 20 and the toner retaining layer 30A be absent, it would ooze out through the surface of the elastic layer 20. In addition, as the softener oozes out the hardness of the rubber becomes as great as JIS (Japanese Industrial Standards) A60° to A90°, depending upon the kind of the softener used and the amount added, rendering the elastic layer unable to serve as an elastic layer of a developing roller. On the other hand, a substantial amount of electrically conducting agent such as carbon powder, nickel powder, iron powder or aluminum powder is added in order to provide the elastic layer 20 with conductivity. Since such conducting agent increases the hardness of the rubber, it is necessary to further increase the amount softener which is added. That the elastic layer 20 contains a great amount of softener is of importance in providing the layer 20 with elasticity.

However, oil from the softener contained in the elastic layer 20 is apt to ooze out as the ambient temperature, or the temperature of the developing roller itself, is elevated. Consider the following three examples of different compositions available for the elastic layer 20:

(1) elastic layer constituted by EPR which is the major component, about 10 weight percent of ethylene glycol which is the softener, and about 30 weight percent of carbon powder which is the conducting agent, the elastic layer having a hardness of about JIS A30° and an electrical resistivity of about $10^4$ Ω cm;

(2) elastic layer constituted by EPR which is the major component, about 50 weight percent of Factice which is the softener, and about 20 weight percent of carbon powder which is the conducting agent, the elastic layer having a hardness of about JIS A25° and a resistivity of about $10^6$ Ω cm; and (3) elastic layer constituted by NBR which is the major component, about 10 weight percent of DOP which is the softener, and about 20 weight percent of carbon powder which is the conducting agent, the elastic layer having a hardness of about JIS A35° and a resistivity of about $10^7$ Ω cm.

With any these elastic layers (1), (2) and (3), especially (1) and (2), the ooze-out of the oil contained in the softener through the surface of the elastic layer is observed even at room temperature. Concerning the elastic layer (3), the oil of the softener begins oozing out through the surface of the elastic layer at a higher temperature (about 50 degrees centigrade).

In the light of this, the developing roller of the illustrative embodiment is constructed such that, as shown in FIG. 2, the toner retaining layer 30A covers all of the surfaces of the elastic layer 20 (both opposite ends 20a and peripheral surface 20b), and the toner retaining layer 30A is made of oil-resistant resin or oil-resistant rubber which does not show affinity to the softener which is contained in the elastic layer 20.

Preferably, the toner retaining layer 30A is implemented by, among various oil resistant materials having elasticity such as elastomer and rubber,: (i) fluorine-based materials including fluorine-containing resin (for example, Teflon 3F, 4F or 6F (tradename for polytetrafluoroethylene)), a mixture of fluorine-containing rubber and less than about 30 weight percent of fluorine-containing resin whose average particle size is less than 10 microns, silicon fluoride rubber, denaturated fluorine resin or rubber (e.g. denaturated fluorine-containing urethane resin or denatured fluorine-containing urethane rubber), (ii) polyimide resins, or (iii) polyether resins (e.g. acetar resin, acetar copolymer resin or polyphenyleneoxide).

The toner retaining layer 30 should preferably, but not necessarily, be conductive. To provide the toner retaining layer 30A with conductivity, the conducting powder or agent as referred to in relation to the elastic layer 20 may be adopted. Preferably, the toner retaining layer 30A contains less than about 10 weight percent (0 weight percent to 10 weight percent) of filler such as carbon powder, red iron oxide, alumina powder, aluminum powder, zinc oxide powder, titanium oxide powder or ceramic powder (e.g. boron nitride powder). The filler will effectively improve the quality of reproductions.

The thickness of the toner retaining layer 30A is substantially 1 micron to 500 microns, preferably substantially 10 microns to 80 microns. More specifically, the thickness of the layer 30A is determined in consideration of the particle size of the filler, weight loss on heating (the softener percentage tends to sequentially decrease due to aging and depending upon the ambient conditions (e.g. temperature) of a developing section where the developing roller is situated), etc. From the standpoint of practical or economical use, a thickness of about 10 microns will suffice for sealing the elastic layer 20. However, a thickness greater than 10 microns is more preferable considering another function assigned to the layer 20, i.e., carrying charged toner thereon while allowing it to maintain its charge.

In practice, the developing roller of the illustrative embodiment may be produced by the following sequence of steps. Specifically, after an elastic layer containing a softener and a conductive agent is formed on a conductive, e.g., metal core, a seal coat agent is applied to the elastic layer in such a manner as to fully cover all of the surfaces of the latter. Examples of the seal coat agent are (a) a solution of denatured fluorine urethane resin (Lumifucon, available from Asahi Glass), (b) a solution of polyimide resin (Sun-Ever, available from Nissan Chemical) and (c) a solution of polyether resin (Eyunor, available from Sumitomo Chemical). Then, the solvent, i.e., toluene, xylene, acetone or similar organic solvent is removed by drying the laminate at room temperature or under the application of heat to provide a toner retaining layer 30A which may be 10 microns to 30 microns thick in the case of seal coat agent (a), 10 microns to 20 microns in the case of seal coat agent (b) and 10 microns to 80 microns in the case of seal coat agent (c).

In order to have an adequate duration of contact with an image carrier at a conventional rotational velocity, the developing roller of the illustrative embodiment should preferably be provided with the following properties. Specifically, the elastic layer 20 has a hardness of 10° to 50° of JIS A30°, preferably 10° to 40°, and a resistivity of $10^1$ Ω cm to $10^{12}$ Ω cm, preferably $10^1$ Ω cm to $10^{10}$ Ω cm. The toner retaining layer 30A is formed of degenerated fluorine rubber, for example, and has a resistivity of $10^6$ Ω cm to $10^{16}$ Ω cm, preferably $10^8$ Ω cm to $10^{16}$ Ω cm. Thus, the resistivity of the toner retaining layer 30A is greater than that of the elastic layer 20.

In summary, it will be seen that the present invention provides a developing roller which prevents a softener contained in an elastic layer from oozing out despite any change in temperature and is therefore operable over a long period of time without its weight being reduced.

Various modifications will become possible for those skilled in the art after receiving the teachings of the present disclosure without departing from the scope thereof.

What is claimed is:

1. A developing roller for an electrophotographic image recorder, comprising:

an elongate conductive core;

an elastic layer formed on said core and comprised by a rubber member containing a softener; and a toner retaining layer covering all surfaces of said elastic layer, whereby said softener cannot ooze out from exposed surfaces of said elastic layer.

2. The developing roller according to claim 1 wherein said toner retaining layer is formed of a material which is oil resistant and does not show affinity to said softener, whereby said softener cannot ooze through said toner retaining layer.

3. The developing roller according to claim 1 wherein said elastic layer is substantially cylindrical and said surfaces of said elastic layer comprise a peripheral surface and axial end surfaces of said elastic layer.

4. The developing roller according to claim 2 wherein said toner retaining layer is formed of rubber.

5. The developing roller according to claim 2 wherein said toner retaining layer is formed from a composition having as a main component a material taken from the group consisting of a fluorine containing resin, a mixture of a fluorine containing rubber and less than 30 weight percent of a fluorine containing resin having an average particle size of less than 10 microns, silicon fluoride rubber, denatured fluoride resin, denatured fluoride rubber, polymide resins and polyether resins.

6. The developing roller according to claim 2 wherein said toner retaining layer is conductive.

7. The developing roller according to claim 5 wherein said toner retaining layer is conductive.

8. The developing roller according to claim 6 wherein said toner retaining layer contains a conducting agent.

9. The developing roller according to claim 7 wherein said toner retaining layer contains a conducting agent.

10. The developing roller according to claim 6 wherein the resistivity of said toner retaining layer is less than the resistivity of said elastic layer.

11. The developing roller according to claim 10 wherein said toner retaining layer has a resistivity of between $10^6$ Ω cm and $10^{16}$ Ω cm.

12. The developing roller according to claim 10 wherein said toner retaining layer has a resistivity of between $10^8$ Ω cm and $10^{16}$ Ω cm.

13. The developing roller according to claim 11 wherein said elastic layer has a resistivity of between $10^1$ Ω cm and $10^{12}$ Ω cm.

14. The developing roller according to claim 11 wherein said elastic layer has a hardness of between 10° and 50° JIS A30°.

15. The developing roller according to claim 2 wherein said toner retaining layer has a thickness of between 1 micron and 500 microns.

16. The developing roller according to claim 2 wherein toner retaining layer has a thickness of between 10 microns and 80 microns.

17. A developing roller for a one-component developer type electrophotographic image recorder, comprising:

an elongate conductive core;

an elastic layer formed on said core, said elastic layer including a softener and having a hardness of 10° to 40° JIS A30 and a resistivity of between about $10^1$ Ω cm and about $10^{10}$ Ω cm; and a toner retaining layer formed of a material which is oil resistant and does not show affinity to said softener, said toner retaining layer having a resistivity of between about $10^8$ Ω cm and about $10^{16}$ Ω cm, wherein the resistivity of said toner retaining layer is selected to be greater than the resistivity of said elastic layer.

18. The developing roller according to claim 17 wherein said toner retaining layer has a thickness of between 10 mcirons and 80 microns.

19. The developing roller according to claim 18 wherein said toner retaining layer includes a conductive agent.

20. In a developing roller for a one-component developer type electrophotographic image recorder, said roller having an elastic layer including a softener, a toner retaining layer comprising an elastic cover covering all surfaces of said elastic layer, said toner retaining layer being formed of a material which is oil resistant and does not show affinity to said softener, said toner retaining layer having a thickness of between 10 microns and 80 microns and a resistivity of between $10^8$ Ω cm and about $10^{16}$ Ω cm.

* * * * *